US010928031B2

(12) United States Patent
Sareyka et al.

(10) Patent No.: US 10,928,031 B2
(45) Date of Patent: Feb. 23, 2021

(54) INDIRECT LIGHT COVE

(71) Applicant: Worthington Armstrong Venture, Malvern, PA (US)

(72) Inventors: Brett W. Sareyka, Glen Mills, PA (US); Joshua L. Neal, Elverson, PA (US)

(73) Assignee: WORTHINGTON ARMSTRONG VENTURE, Malvern, PA (US)

( * ) Notice: Subject to any disclaimer, the term of this patent is extended or adjusted under 35 U.S.C. 154(b) by 46 days.

(21) Appl. No.: 15/313,355

(22) PCT Filed: Oct. 10, 2016

(86) PCT No.: PCT/US2016/056254

§ 371 (c)(1),
(2) Date: Nov. 22, 2016

(87) PCT Pub. No.: WO2017/062944

PCT Pub. Date: Apr. 13, 2017

(65) Prior Publication Data

US 2018/0202628 A1 Jul. 19, 2018

Related U.S. Application Data

(60) Provisional application No. 62/239,478, filed on Oct. 9, 2015, provisional application No. 62/397,070, filed on Sep. 20, 2016.

(51) Int. Cl.
*F21V 3/02* (2006.01)
*F21S 8/02* (2006.01)
(Continued)

(52) U.S. Cl.
CPC ..... *F21V 3/02* (2013.01); *E04B 9/006* (2013.01); *E04B 9/30* (2013.01); *F21S 8/026* (2013.01);
(Continued)

(58) Field of Classification Search
CPC ..... F21V 3/02; F21V 17/12; F21V 21/088; F21V 21/00; E04B 9/006; E04B 9/30; E04B 2009/062; F21S 8/026
See application file for complete search history.

(56) References Cited

U.S. PATENT DOCUMENTS 3,798,865 A * 3/1974 Curtis ..... E04B 9/127 403/189
4,725,931 A * 2/1988 Bourdon ..... F21V 7/0008 362/147
(Continued)

FOREIGN PATENT DOCUMENTS

| | | |
|---|---|---|
| CN | 204520223 | 8/2015 |
| EP | 1132541 | 9/2001 |
| FR | 2686109 | 7/1993 |

*Primary Examiner* — Basil S Katcheves
*Assistant Examiner* — Omar F Hijaz
(74) *Attorney, Agent, or Firm* — Stradley Ronon Stevens and Young, LLP

(57) ABSTRACT

An indirect light cove system including an edge piece, a ceiling beam connector, a ceiling beam with a web and flanges, and a lighting module. The edge piece includes an end bar, upper and lower lateral arms attached to the end bar, beam connection hooks between the upper and lower lateral arms, and one or more key protrusions on an upper face of the upper lateral arm. The ceiling beam connector includes a rectangular channel portion having top and bottom surfaces in contact with the beam connection hooks, and a beam portion joined to the channel portion. The ceiling beam is joined to the beam portion of the ceiling beam connector by fastening elements inserted through screw holes in the beam portion and the web. The flanges rest on the lower lateral arm of the edge piece. The lighting module includes a key recess which conforms to the key protrusions.

11 Claims, 17 Drawing Sheets

(51) Int. Cl.

| | |
|---|---|
| ***F21V 21/088*** | (2006.01) |
| ***F21V 17/12*** | (2006.01) |
| ***E04B 9/30*** | (2006.01) |
| ***E04B 9/00*** | (2006.01) |
| ***E04B 9/06*** | (2006.01) |
| ***F21V 21/00*** | (2006.01) |

(52) U.S. Cl.
CPC ..... *F21V 17/12* (2013.01); *F21V 21/088* (2013.01); *E04B 2009/062* (2013.01); *F21V 21/00* (2013.01)

(56) References Cited

U.S. PATENT DOCUMENTS

| | | | | |
|---|---|---|---|---|
| 5,572,844 | A | 11/1996 | Stackenwalt et al. | |
| 6,438,921 | B1 | 8/2002 | Moore | |
| 8,156,702 | B2 | 4/2012 | Kim | |
| 8,763,336 | B2 * | 7/2014 | Gulbrandsen | E04B 9/10 52/288.1 |
| 8,813,457 | B2 * | 8/2014 | Underkofler | E04B 9/30 52/712 |
| 9,335,033 | B2 * | 5/2016 | Gagne | F21V 21/048 |
| 10,100,519 | B2 * | 10/2018 | Bergman | E04B 9/242 |
| 2005/0160696 | A1 * | 7/2005 | Kelly | E04B 9/067 52/712 |
| 2007/0130869 | A1 * | 6/2007 | Platt | E04B 9/067 52/506.08 |
| 2011/0317435 | A1 * | 12/2011 | Wang | F21V 21/025 362/370 |
| 2013/0314907 | A1 | 11/2013 | Swisha et al. | |
| 2014/0000205 | A1 | 1/2014 | Underkofler et al. | |

* cited by examiner

INDIRECT LIGHT COVE

RELATED APPLICATIONS

This application is the United States National Phase of International Application No. PCT/US2016/056254 filed Oct. 10, 2016, which claims the benefit of priority to U.S. Provisional Patent Application Ser. No. 62/239,478 filed Oct. 9, 2015, and U.S. Provisional Patent Application Ser. No. 62/397,070 filed Sep. 20, 2016, the contents of which are incorporated in this application by reference.

TECHNICAL FIELD

The present invention relates generally to ceiling systems, and more particularly to indirect light coves for suspended ceiling systems.

BACKGROUND OF THE INVENTION

Some ceiling systems include a grid support system hung from an overhead structure (i.e., a suspended ceiling system) which includes an array of orthogonally intersecting longitudinal grid support members and lateral grid support members arranged in a fairly uniform pattern with regular intervals. The longitudinal grid support members and the lateral grid support members define a plurality of grid openings configured to support individual ceiling panels. Mechanical and electrical utilities (such as wiring, plumbing, etc.) may be conveniently routed in a hidden manner in the cavity or plenum formed above the grid support members and ceiling panels, making suspended ceiling systems a practical and popular ceiling option for residential, commercial, and industrial building spaces.

It is often desirable to create a cove along a perimeter of the suspended ceiling system (e.g., between the suspended ceiling system and an adjacent wall) into which a lighting module may be installed. It is often further desirable for the lighting module to face upward toward a higher surface such that the light is radiated indirectly into the space below. Such indirect light coves often include a knife edge, where the edge of the indirect light cove is angled relative to an adjacent vertical wall. Traditionally, this detail is completed with studs and drywall materials, and the architect details this part of the building with little planning or thought to how it gets constructed. As a result, ceiling light coves are often needlessly complex and difficult to construct, and therefore very expensive due to this added labor.

Accordingly, there is a need for indirect ceiling light coves which offer predictable lighting performance as well as simple and inexpensive installation.

SUMMARY

Embodiments of the invention include an indirect light cove edge piece including an end bar, an upper lateral arm joined to the end bar, a lower lateral arm joined to the end bar below the upper lateral arm, one or more beam connection hooks on the end bar between the upper lateral arm and the lower lateral arm, and one or more key protrusions on an upper face of the upper lateral arm. The lower lateral arm is parallel to the upper lateral arm. The indirect light cove edge piece may further include a pin hole located on the end bar or the upper lateral arm, one or more splice plate connection hooks on the end bar above the upper lateral arm, or both. The indirect light cove edge piece may be made of a single piece of extruded metal. The upper lateral arm may join the end bar at an angle other than 90 degrees, and the upper lateral arm and the end bar may form an acute angle above the upper lateral arm. The upper lateral arm may join the end bar at an angle of approximately 30-60 degrees. The indirect light cove edge piece may further include a bottom lateral arm joined to the end bar below the lower lateral arm having an upward-pointing end protrusion at an end of the lower lateral arm opposite the end bar, a lower protrusion extending from the bottom lateral arm parallel to the end bar, and a textured bottom surface.

Embodiments of the invention further include an angled ceiling beam connector including a rectangular channel portion and a beam portion joined at an angle to the channel portion. The rectangular channel portion includes a pair of opposing square corners, a pair of opposing rounded corners, a substantially flat top surface, and a substantially flat bottom surface. The beam portion includes a plurality of screw holes, one or more of which may be slotted.

Embodiments further include an indirect light cove system including an edge piece, a ceiling beam connector, a first ceiling beam, and a lighting module. The edge piece includes an end bar, an upper lateral arm joined to the end bar, a lower lateral arm joined to the end bar below the upper lateral arm, the lower lateral arm being parallel to the upper lateral arm, one or more beam connection hooks on the end bar between the upper lateral arm and the lower lateral arm, and one or more key protrusions on an upper face of the upper lateral arm. The ceiling beam connector includes a rectangular channel portion having a top surface and a bottom surface in contact with the beam connection hooks of the edge piece, and a beam portion joined to the channel portion including a plurality of screw holes. The first ceiling beam including a bulb, a vertical web extending down from the bulb, and horizontally extending flanges at the bottom of the web. The first ceiling beam is joined to the beam portion of the first ceiling beam connector by one or more fastening elements inserted through the screw holes of the beam portion and the web of the first ceiling beam, and the flanges of the first ceiling beam rest on the lower lateral arm of the edge piece.

The lighting module includes a key recess which substantially conforms to the key protrusions of the edge piece, and the lighting module rests on the upper lateral arm with the key protrusions inserted into the key recess. The edge piece may be made of a single piece of extruded metal. The upper lateral arm may be joined to the end bar at an angle other than 90 degrees, and the upper lateral arm and the end bar form an acute angle above the upper lateral arm. The upper lateral arm may be joined to the end bar at an angle of approximately 30-60 degrees. The first ceiling beam may include an edge adjacent to the edge piece, where the edge of the first ceiling beam forms substantially the same angle with the flanges as the upper lateral arm forms with the end bar. The edge piece may further include a bottom lateral arm joined to the end bar below the lower lateral arm, the bottom lateral arm including an upward-pointing end protrusion at an end of the lower lateral arm opposite the end bar, and a lower protrusion extending from the bottom lateral arm parallel to the end bar, and the indirect light cove system further includes a drywall panel attached to the flanges of the drywall panel attached to the flanges of the first ceiling beam by a plurality of drywall screws, an edge of the drywall panel contacting with the upward-pointing end protrusion of the bottom lateral arm and a bottom surface of the drywall panel being substantially flush with a bottom surface of the bottom lateral.

The indirect light cove system may further include a layer of drywall mud applied to the bottom of the drywall panel, the layer of drywall mud being substantially flush with a bottom surface of the lower protrusion of the bottom lateral arm. The indirect light cove system may further include a suspension hanger attached to a bottom surface of the upper lateral arm of the edge piece, the suspension hanger secured to the upper lateral arm by a fastening element inserted through the suspension hanger and the upper lateral arm between two of the plurality of key protrusions. The suspension hanger may further be connected to a wall clip secured to a structural wall. The suspension hanger may be further connected to a second ceiling beam higher than the first ceiling beam. One or more of the screw holes in the beam portion are slotted.

BRIEF DESCRIPTION OF THE DRAWING

The invention is best understood from the following detailed description when read in connection with the accompanying drawing. It is emphasized that, according to common practice, the various features of the drawing are not to scale. On the contrary, the dimensions of the various features are arbitrarily expanded or reduced for clarity. Included in the drawing are the following figures.

DETAILED DESCRIPTION

Figure 1:
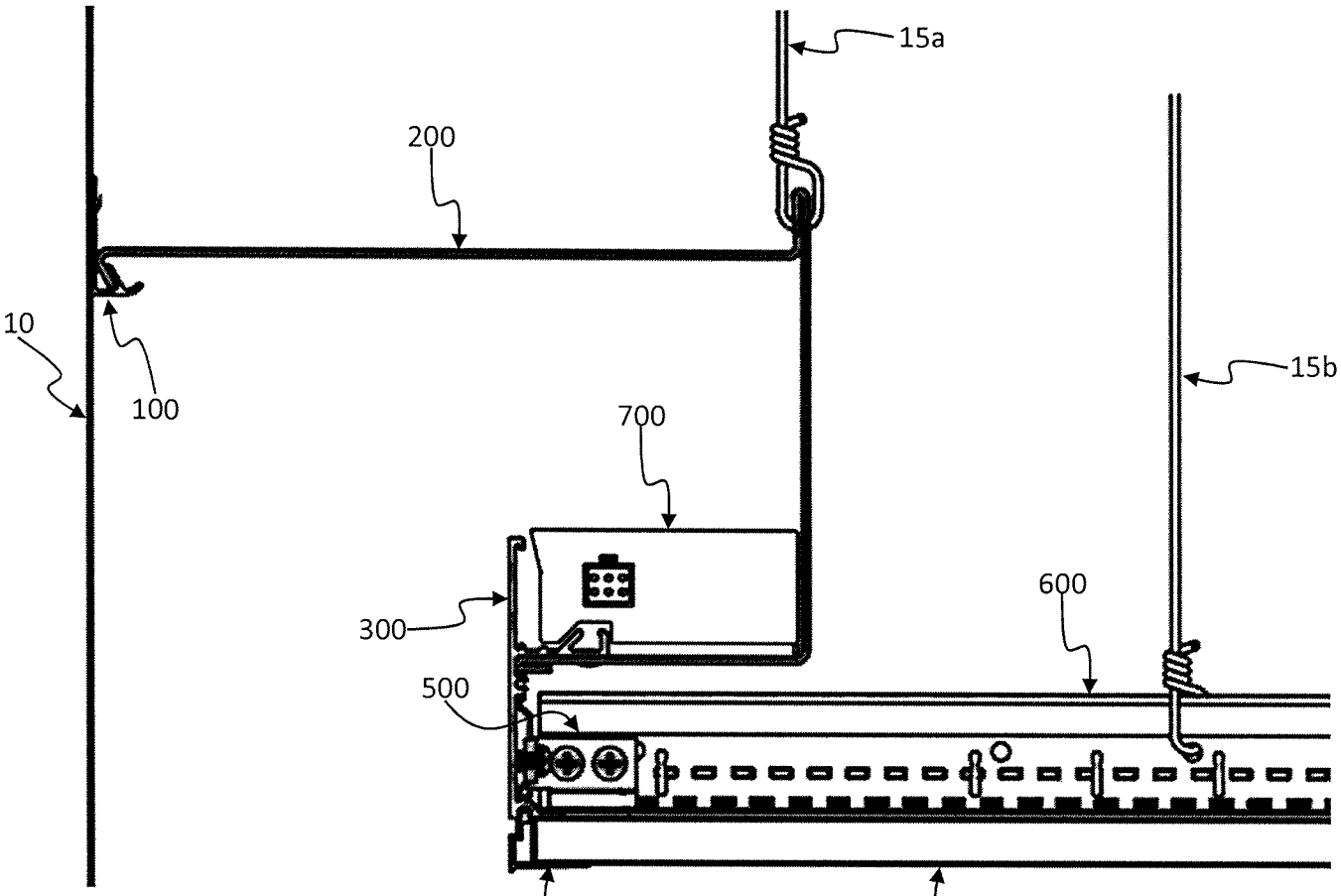
FIG. 1 is a side view of an indirect light cove system, according to an embodiment of the invention.

Referring now to the drawing, in which like reference numbers refer to like elements throughout the various figures that comprise the drawing, embodiments of the invention include indirect light cove systems for suspended ceilings. The indirect light coves include a cove edge piece which allows for a smooth and clean integration with the suspended ceiling system and components for securing the cove edge piece to a nearby structure.

Referring to FIG. 1, an exemplary indirect light cove system is provided according to an embodiment of the invention. The indirect light cove system includes a wall clip 100, a wall suspension hanger 200, a vertical cove edge piece 300, a vertical ceiling beam connector 500, a ceiling beam 600, and a lighting module 900.

Figure 2:
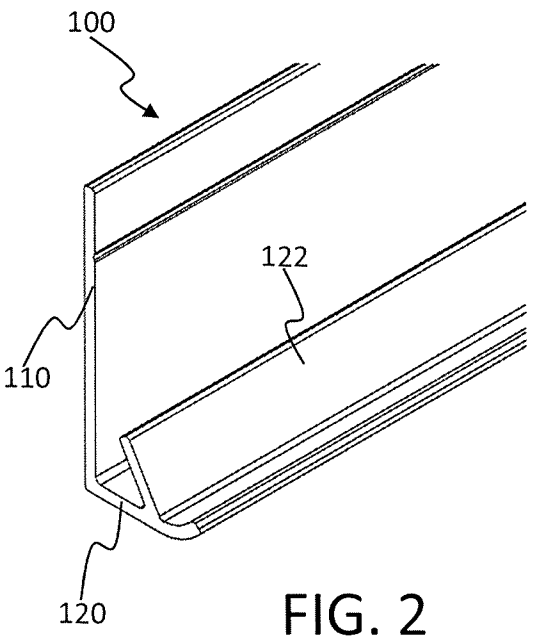
FIG. 2 is a perspective view of a wall clip, according to an embodiment of the invention.

Referring to FIG. 2, the wall clip 100 includes a vertical wall-contacting portion 110 and a horizontal leg 120 at the bottom of the vertical wall-contacting portion 110 which is substantially perpendicular to the vertical wall-contacting portion 110. The horizontal leg 120 includes a protrusion 122 on an upper surface of the horizontal leg 120 which is angled back toward the vertical wall-contacting portion 110. To install the indirect light cove system, the wall clip 100 is first attached to a structural wall 10 (FIG. 1), for example by a plurality of fastening elements (not shown) such a screws inserted through the vertical wall-contacting portion 110 and into the structural wall 10.

Figure 3:
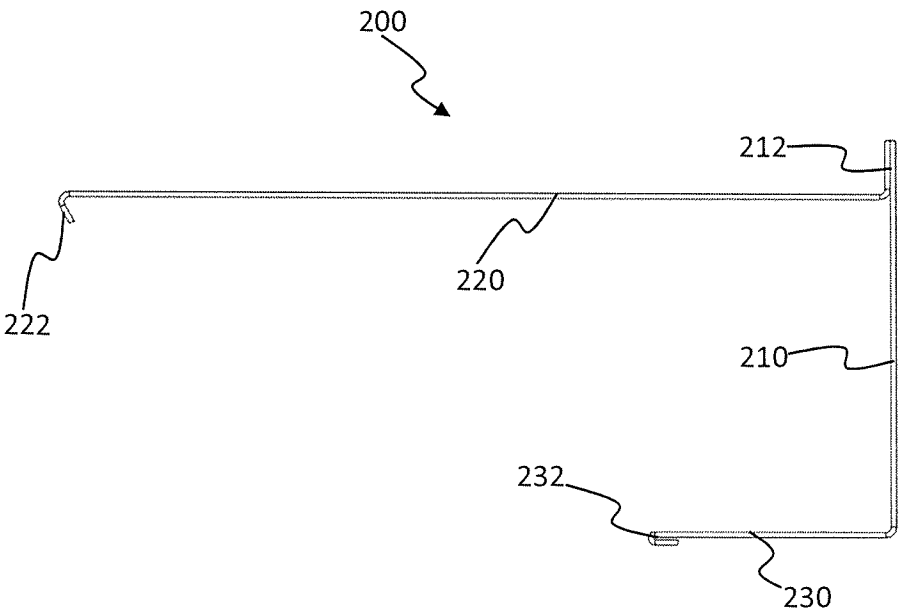
FIG. 3 is a side view of a wall suspension hanger, according to an embodiment of the invention.

Referring to FIG. 3, the wall suspension hanger 200 includes a vertical portion 210, and a top vertical arm 220 and a bottom vertical arm 230 extending horizontally in the same direction from opposite ends of the vertical portion 210. The top vertical arm 220 includes a downward facing hook 222 at the end opposite the vertical portion 210. The bottom vertical arm 230 includes a reinforcing bend 232 at the end opposite the vertical portion 210. The vertical portion 210 further includes an extension 212 which extends past the top vertical arm 220. In some embodiments, the suspension hanger 200 may be formed from a single sheet of metal and the extension 212 may be formed by a 180° bend in the sheet. In other embodiments, the suspension hanger 200 may be formed from two sheets of metal attached at the extension 212 by suitable fastening elements such as screws. The suspension hanger 200 is installed as part of the indirect light cove system by slotting the downward facing hook 222 over the protrusion 122 of the wall clip 100 and then attaching a hanger wire 15*a* to the extension 212 (FIG. 1). The other end of the hanger wire 15*a* is secured to a structure (not shown) above the indirect light cove system.

Figure 4:
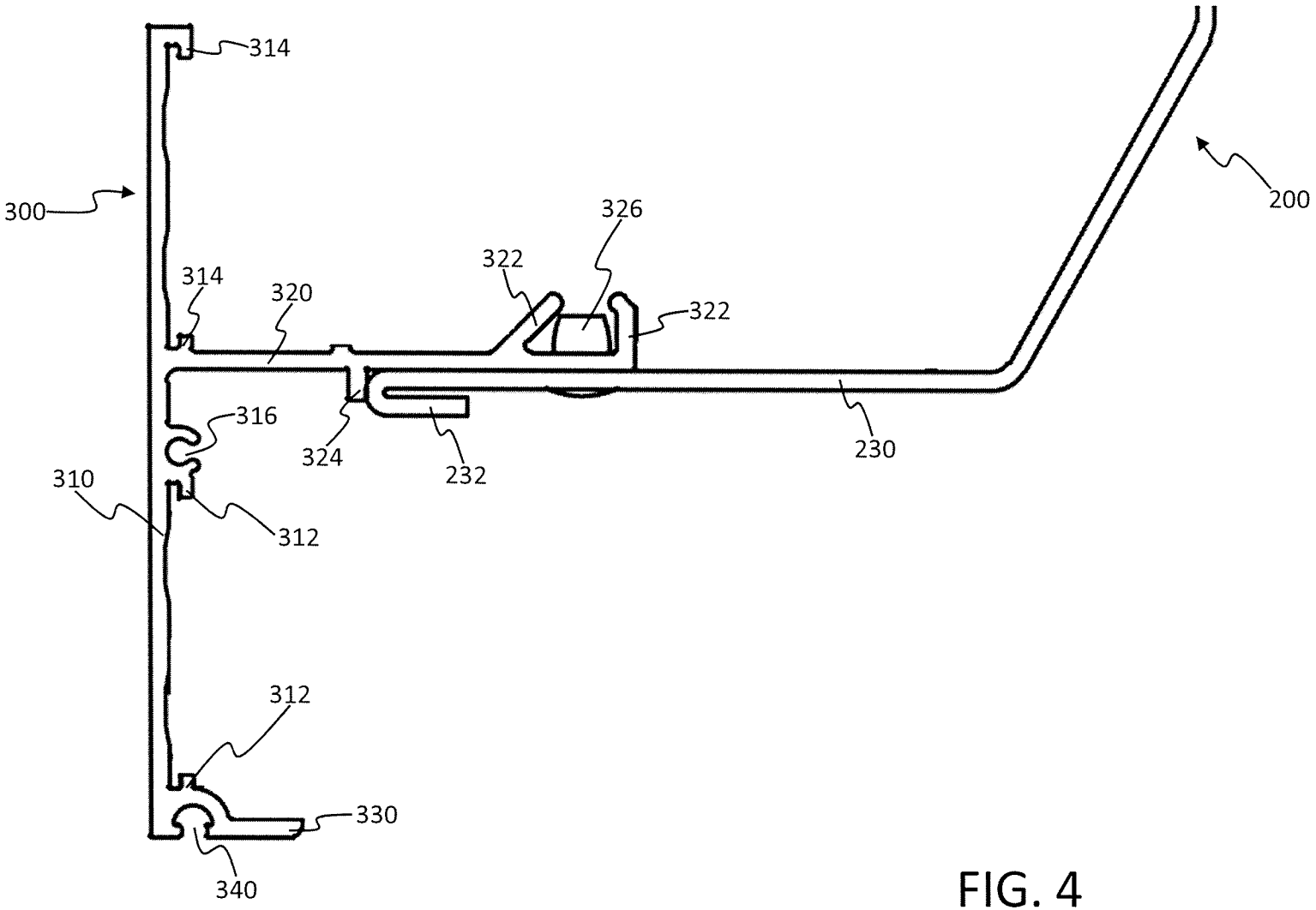
FIG. 4 is a side view of an indirect light cove system including a vertical cove edge piece attached to a wall suspension hanger, according to an embodiment of the invention.

Referring to FIG. 4, the vertical cove edge piece 300 includes an end bar 310, an upper lateral arm 320, and a lower lateral arm 330. In the embodiment depicted in FIG. 4, the upper lateral arm 320 and a lower lateral arm 330 are substantially perpendicular to the end bar 310. The vertical cove edge piece 300 may be formed of a single piece of extruded metal. Alternatively, the vertical cove edge piece 300 may be made of multiple pieces.

The upper lateral arm 320 extends from an upper portion of the end bar 310 short of the terminal end of the end bar 310. The upper lateral arm 320 includes key protrusions 322 on an upper face of the upper lateral arm 320. The key protrusions 322 match indentations on corresponding compatible light fixtures which are installed above the vertical cove edge piece 300 to ensure that only compatible light fixtures are used. Incompatible light fixtures will not align with the key protrusions 322 and therefore not fit above the upper lateral arm 320. In some embodiments, the upper lateral arm 320 further includes a vertical stop 324 on a bottom surface of the upper lateral arm 320.

The lower lateral arm 330 extends from the bottom of the end bar 310 and has an aperture 340. The end bar 310 further includes a pair of beam connection hooks 312 between the upper lateral arm 320 and the lower lateral arm 330, a pair of splice plate connection hooks 314 above the upper lateral arm 320, and a pin hole 316 between the lower lateral arm 330 and the upper lateral arm 320. As described in more detail below, the beam connection hooks 312 are used to attach the vertical cove edge piece 300 to an adjacent ceiling beam 600 (FIG. 1). Where multiple vertical cove edge pieces 300 are used, a pin may be inserted into the pin hole 316 of adjacent vertical cove edge pieces 300 to ensure alignment between the adjacent vertical cove edge pieces 300. A splice plate may also be inserted between the splice plate connection hooks 314 of adjacent vertical cove edge pieces 300 to further secure the adjacent vertical cove edge pieces 300. The vertical cove edge piece 300 is secured to structure by the wall suspension hanger 200, which extends below the upper lateral arm 320 and is attached to the upper lateral arm 320 by a fastening element 326 inserted between the key protrusions 322. In embodiments where the upper lateral arm 320 includes the vertical stop 324, the bottom vertical arm 230 may contact the vertical stop 324 to align the wall suspension hanger 200 and the vertical cove edge piece 300. In other embodiments where the upper lateral arm 320 does not include the vertical stop 324 (FIG. 1), the bottom vertical arm 230 may or may not contact the end bar 310 to align the wall suspension hanger 200 and the vertical cove edge piece 300.

Figure 5:
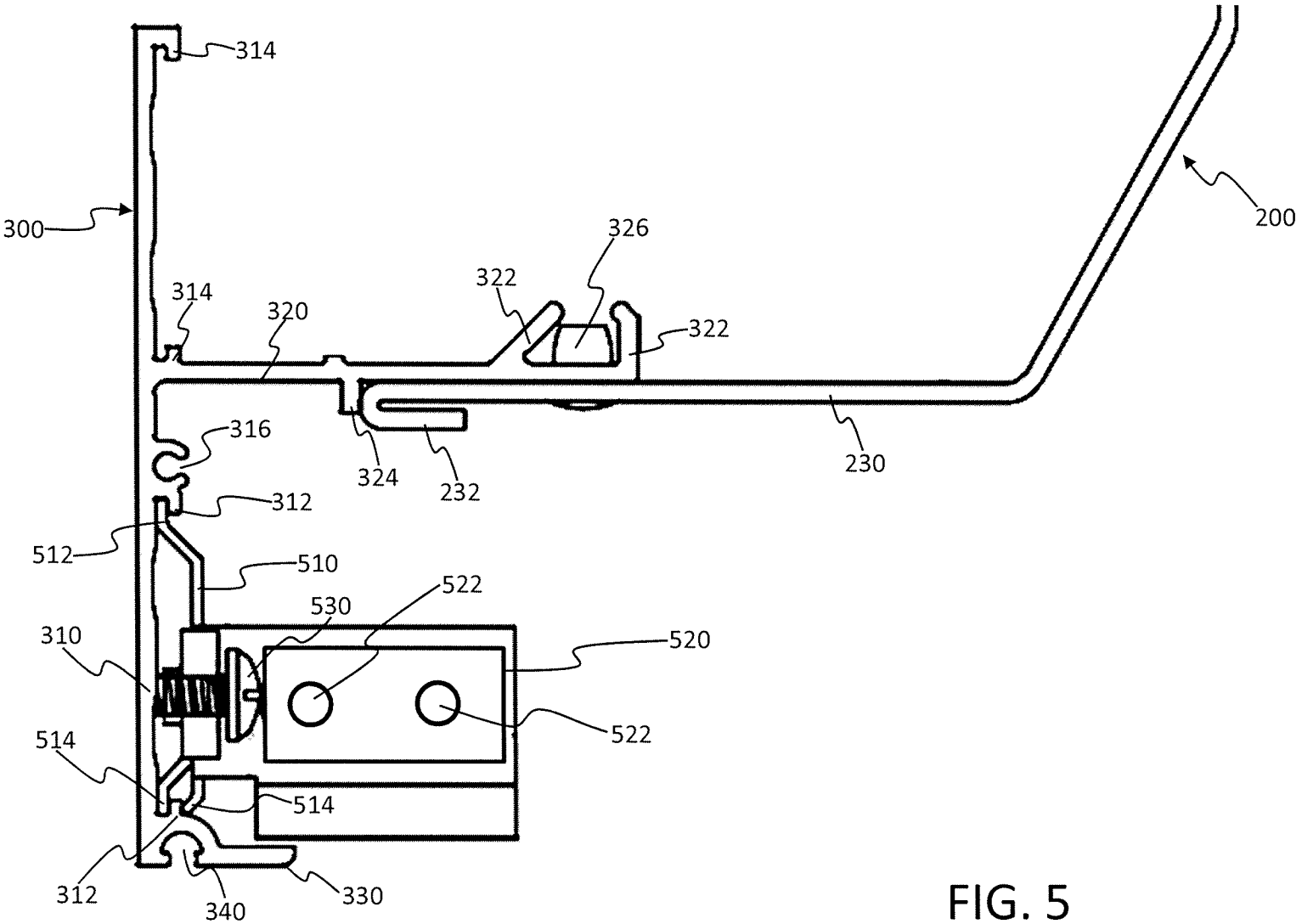
FIG. 5 is a side view of an indirect light cove system including a vertical ceiling beam connector, according to an embodiment of the invention.

Referring to FIG. 5, the vertical ceiling beam connector 500 includes a channel portion 510 attached to a beam portion 520 and a set screw 530 which extends through a central region of the channel portion 510. The channel portion 510 includes an upper rail 512 and a pair of lower rails 514, and the beam portion 520 includes a plurality of screw holes 522. The vertical ceiling beam connector 500 is attached to the vertical cove edge piece 300 by slotting the upper rail 512 and lower rails 514 between the beam connection hooks 312 and sliding the vertical ceiling beam connector 500 laterally to the desired position. Once in position, the set screw 530 is tightened to bring the lower rails 514 together. The lower rails 514 pinch the lower beam connection hook 312 and secure the vertical ceiling beam connector beam 500.

Figure 6:
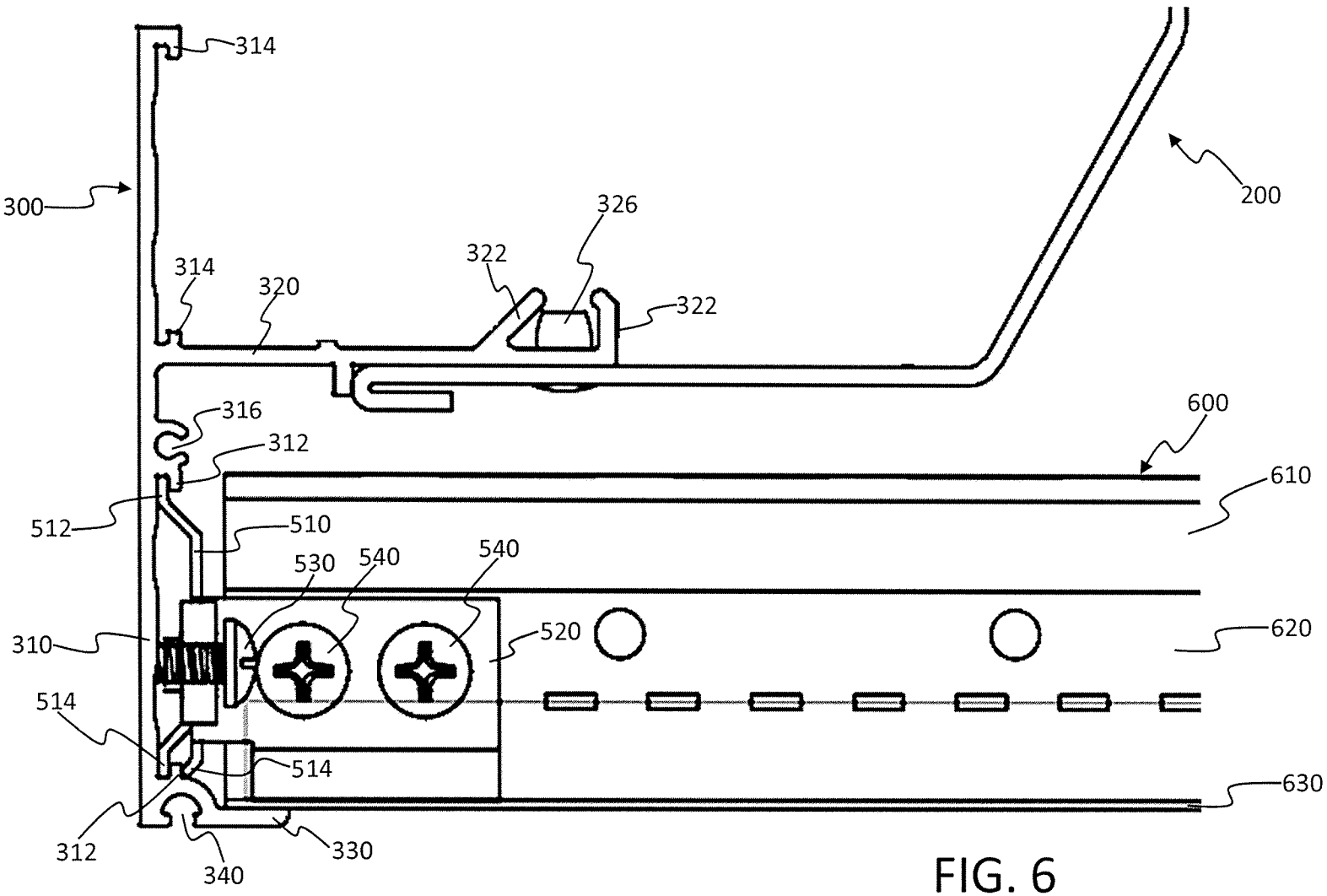
FIG. 6 is a side view of an indirect light cove system including a ceiling beam, according to an embodiment of the invention.
Figure 7:
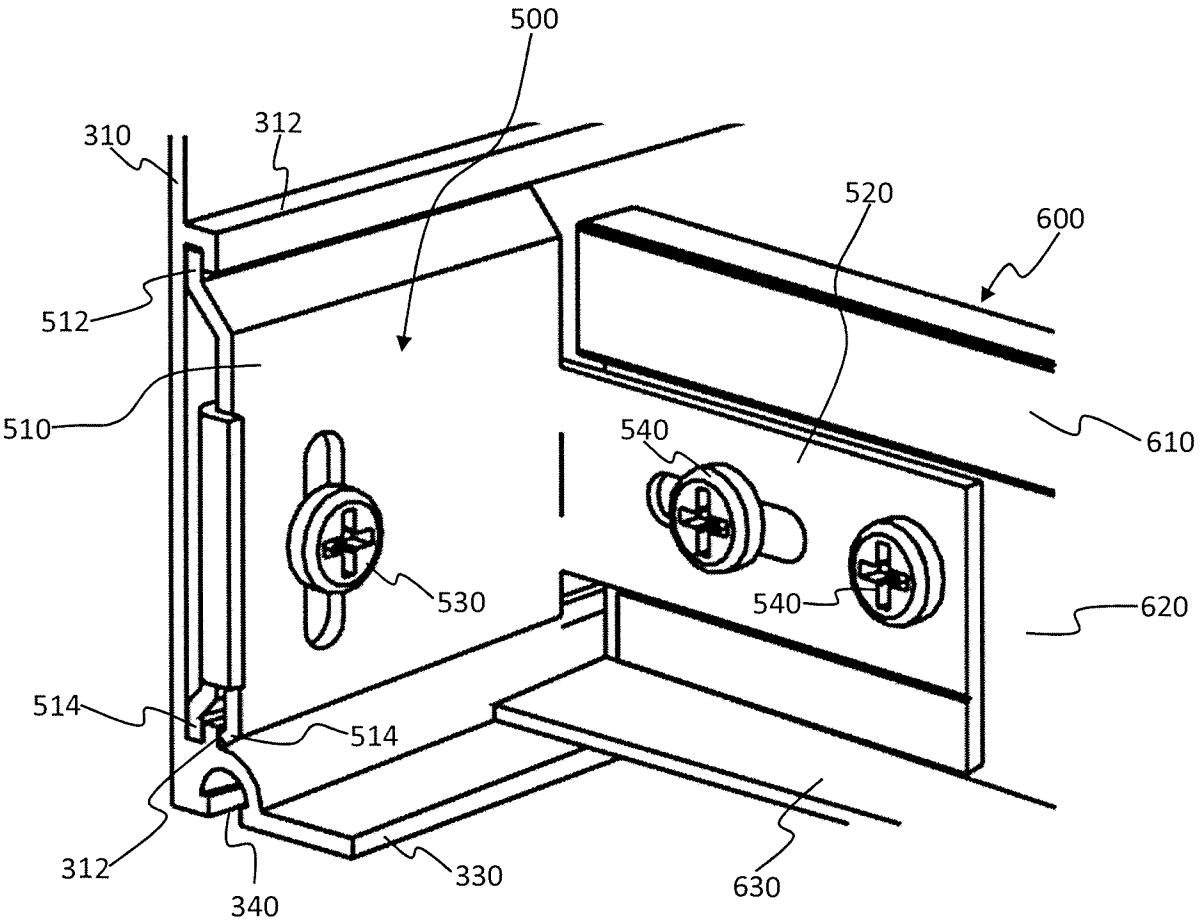
FIG. 7 is a perspective view of an indirect light cove system including a ceiling beam, according to an embodiment of the invention.

Referring to FIGS. 6 and 7, the ceiling beam 600 includes, in cross section, a bulb 610 at the top, a vertical downward extending web 620, and horizontally extending flanges 630 at the bottom of the web 620. The ceiling beam 600 attaches to the vertical ceiling beam connector 500 by a plurality of fastening elements 540, such as screws, inserted through the screw holes 522 and through the web 620. In some embodiments, one or more of the screw holes 522 may be slotted to allow for variation in the position of the ceiling beam 600. The flanges 630 rest on the lower lateral arm 330 of the vertical cove edge piece 300 for additional support. The ceiling beam 600 may also be secured to a structure above the indirect light cove by a hanger wire 15*b* (FIG. 1).

Figure 8:
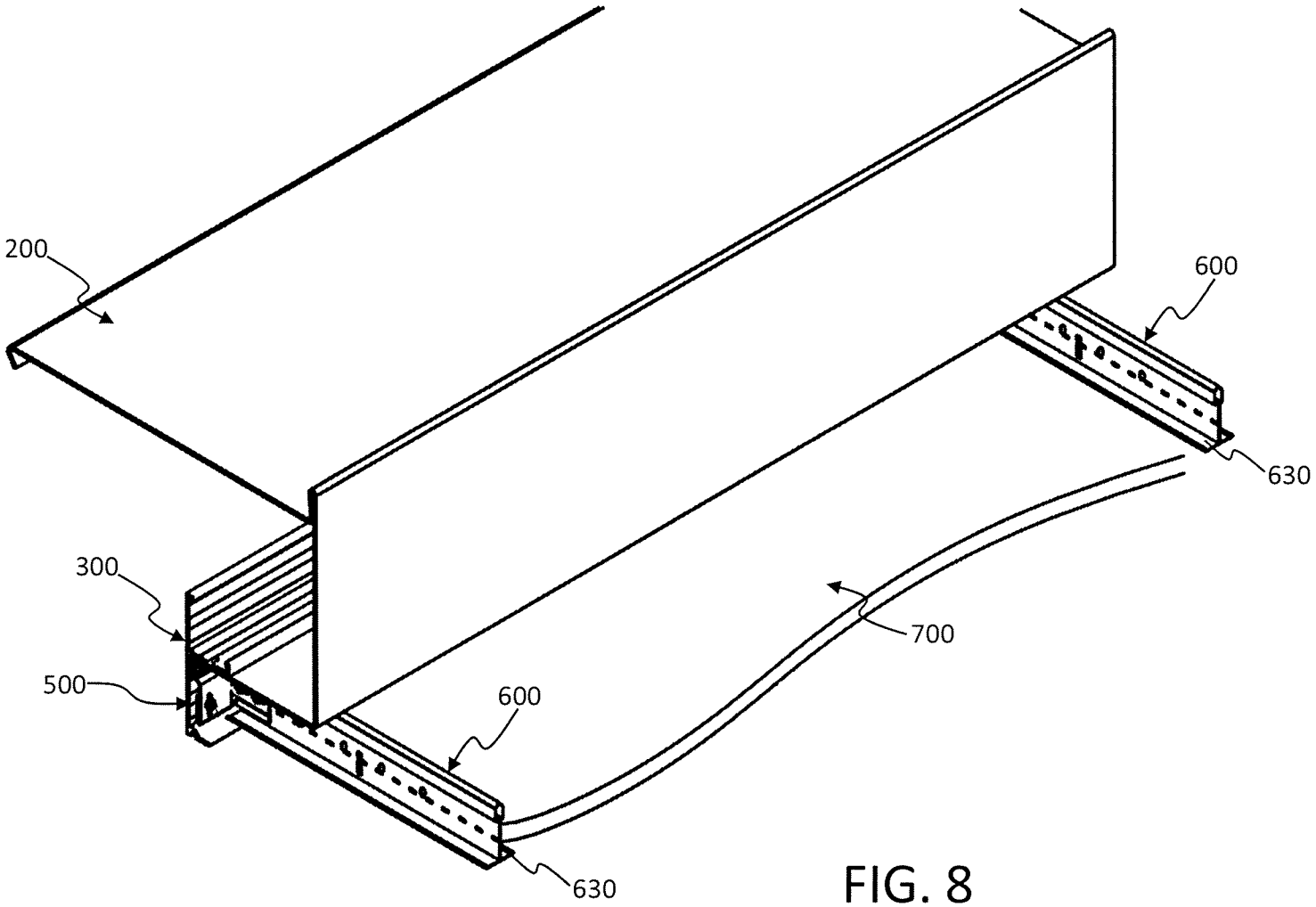
FIG. 8 is a perspective view of an indirect light cove system including multiple ceiling beams, according to an embodiment of the invention.

Referring to FIG. 8, multiple ceiling beams 600 may be attached to the vertical cove edge piece 300 to form a grid. Once the ceiling beams 600 are attached, ceiling panels 700 may be placed on the flanges 630 of the ceiling beams 600 to form the suspended ceiling.

Figure 9:
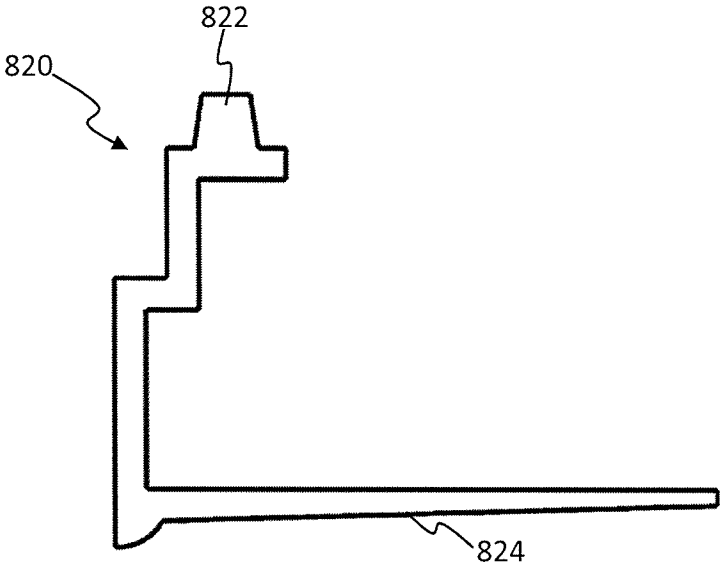
FIG. 9 is a side view of a drywall trim clip, according to an embodiment of the invention.

Alternatively, drywall panels 800 may be attached to the bottoms of the flanges 630, as depicted in FIG. 1. Typically, the drywall panels 800 are attached to the flanges 630 by a plurality of drywall screws (not shown). In some embodiments, a drywall trim clip 820 (FIG. 9) may be used. The plug end 822 of the drywall trim clip 820 plugs into a clip recess 390 and the base portion 824 covers the ends of the drywall panels 800 to provide a uniform appearance to the indirect light cove.

Figure 10A:
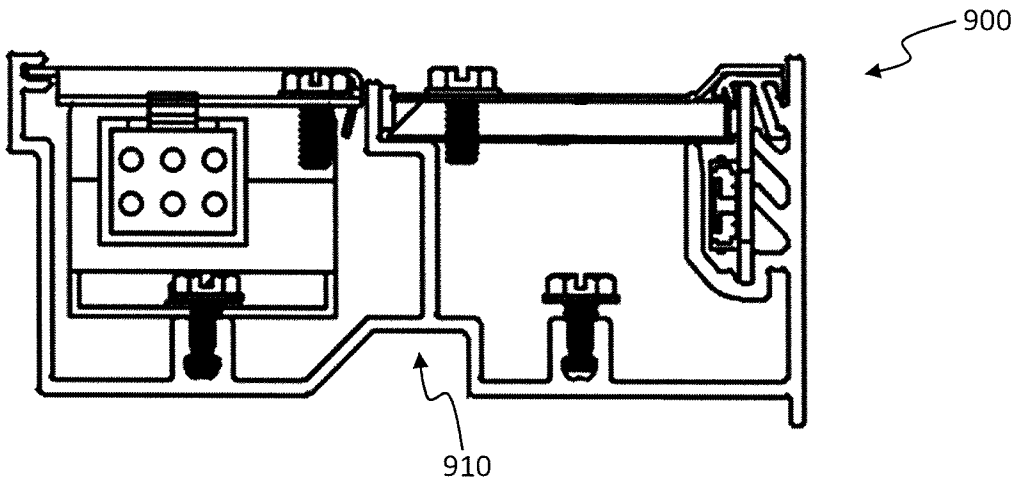
FIG. 10A is a side view of a lighting module, according to an embodiment of the invention.
Figure 10B:
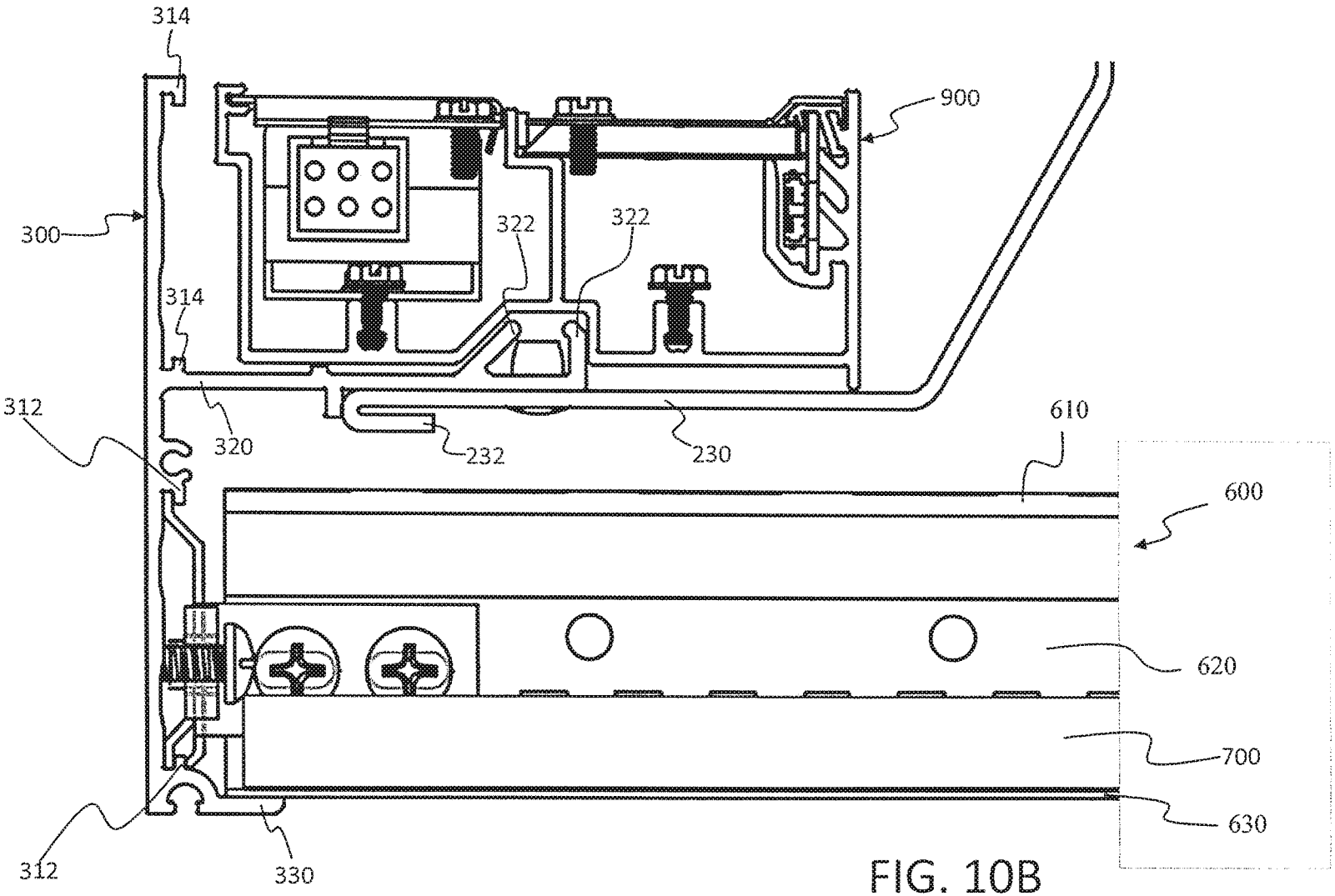
FIG. 10B is a side view of an indirect light cove system including a lighting module, according to an embodiment of the invention.

Referring to FIG. 10A, after the vertical cove edge piece 300 is attached to the wall suspension hanger 200, the lighting module 900 may be installed above the vertical cove edge piece 300. The lighting module 900 includes a key recess 910 (FIG. 10B) which substantially conforms to the key protrusions 322 of the vertical cove edge piece 300. Incompatible light fixtures will not align with the key protrusions 322 and therefore not fit above the upper lateral arm 320. Accordingly, the key protrusions 322 ensure that only compatible light fixtures are used in the indirect light cove system.

Figure 11A:
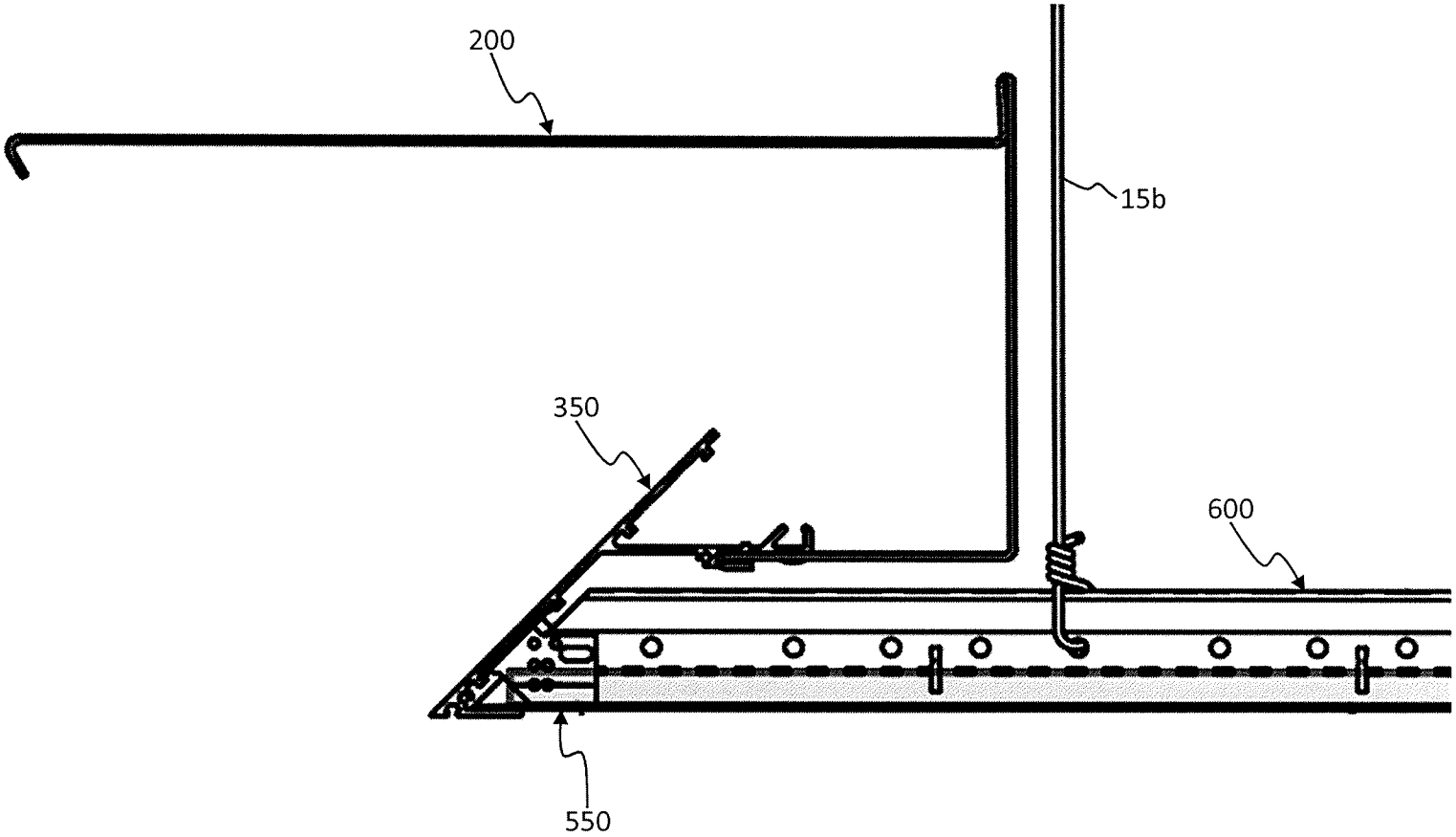
FIG. 11A is a side view of an indirect light cove system including an angled cove edge piece, according to an embodiment of the invention.
Figure 11B:
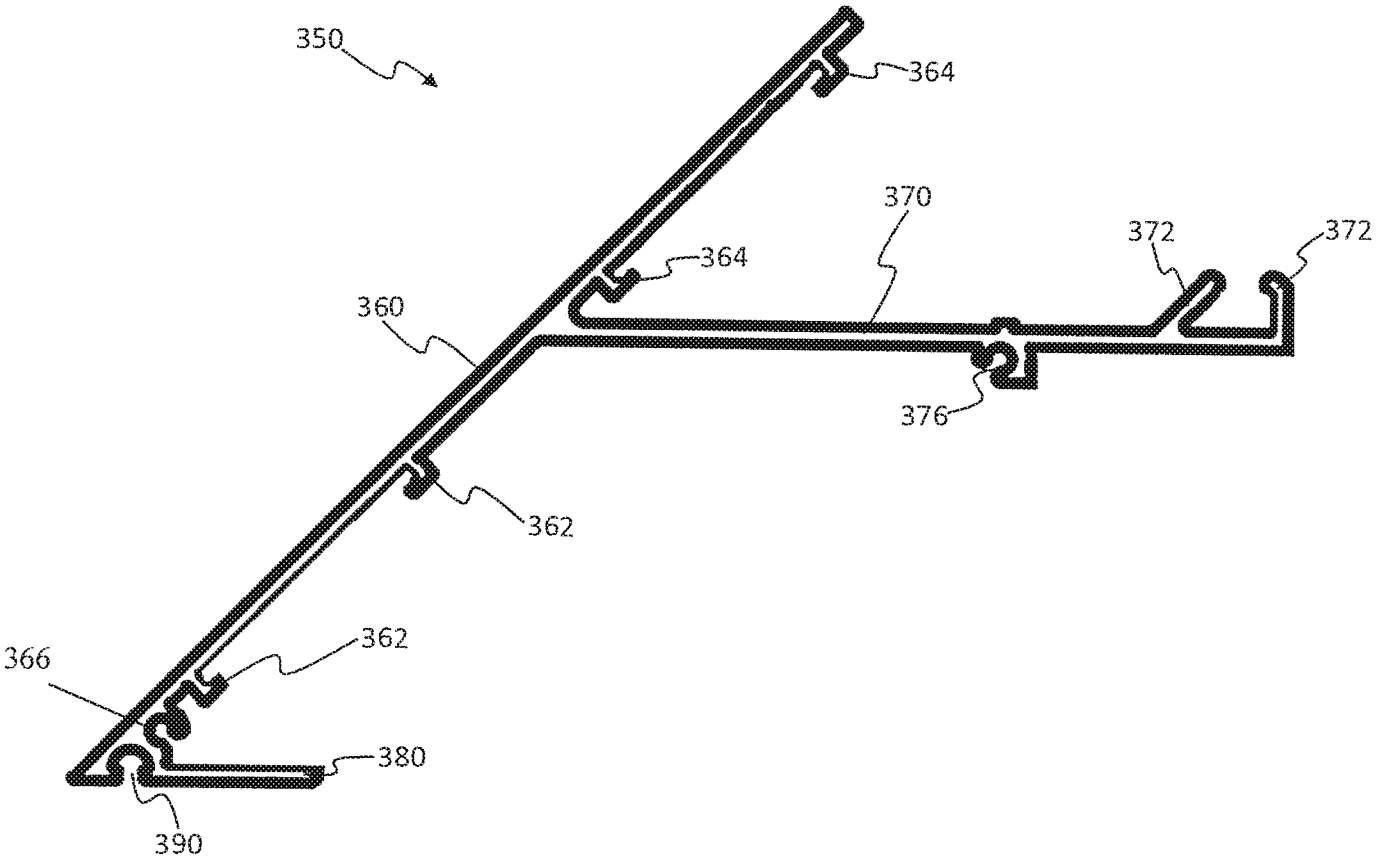
FIG. 11B is a side view of an angled cove edge piece, according to an embodiment of the invention.

Referring to FIG. 11A, in other embodiments it may be desirable for the indirect light cove to have an angled face, rather than a vertical face as described above. Accordingly, embodiments of the invention also include indirect light cove systems including a wall clip 100 (FIG. 1), a wall suspension hanger 200 (FIG. 3), an angled cove edge piece 350, an angled ceiling beam connector 550, and a ceiling beam 600. Substituting the angled cove edge piece 350 and the angled ceiling beam connector 550 for the vertical cove edge piece 300 and the vertical ceiling beam connector 500 creates the angled cove edge face while maintaining the same connections described above.

The angled cove edge piece 350 includes an angled end bar 360, an upper lateral arm 370 and a lower lateral arm 380. The angled end bar 360 joins the upper lateral arm 370 and the lower lateral arm 380 at angle of other than 90°. In an exemplary embodiment, each lateral arm forms an acute angle with the angled end bar 360 above the lateral arm and an obtuse angle with the angled end bar 360 below the lateral arm. The acute angle formed by the angled end bar 360 and each lateral arm may be any angle less than 90°, preferably approximately 30°-60°, and more preferably approximately 45°. The angled cove edge piece 350 may be formed of a single piece of extruded metal. Alternatively, the angled cove edge piece 350 may be made of multiple pieces.

The upper lateral arm 370 extends from an upper portion of the end bar 360 short of the terminal end of the angled end bar 360. The upper lateral arm 370 includes key protrusions 372 on an upper face of the upper lateral arm 370 and a pin hole 376 on a lower face of the upper lateral arm 370. The pin hole 376 may also serve as a vertical stop, similar to the vertical stop 324 described above. Alternatively, the pin hole 376 may be excluded and a vertical stop (not shown) may be included in its place. The key protrusion 372 matches an indentation on corresponding compatible light fixtures which are installed above the vertical cove edge piece 300 to ensure that only compatible light fixtures are used. Incompatible light fixtures will not align with the key protrusions 372 and therefore not fit above the upper lateral arm 370. Where multiple angled cove edge pieces 350 are used, a pin (not shown) may be inserted into the pin hole 376 of the angled cove edge pieces 350 to ensure alignment between the adjacent angled cove edge pieces 350.

The lower lateral arm 380 extends from the bottom of the angled end bar 360. The angled end bar 360 further includes a pair of beam connection hooks 362 between the upper lateral arm 370 and the lower lateral arm 380, a pair of splice plate connection hooks 364 above the upper lateral arm 370, and a pin hole 366 between the lower lateral arm 380 and the upper lateral arm 370. As described in more detail below, the beam connection hooks 362 are used to attach the angled cove edge piece 350 to an adjacent ceiling beam 600 (FIG. 11A). A splice plate (not shown) may also be inserted between the splice plate connection hooks 364 of adjacent angled cove edge pieces 350 to further secure the adjacent angled cove edge pieces 350.

Figure 11C:
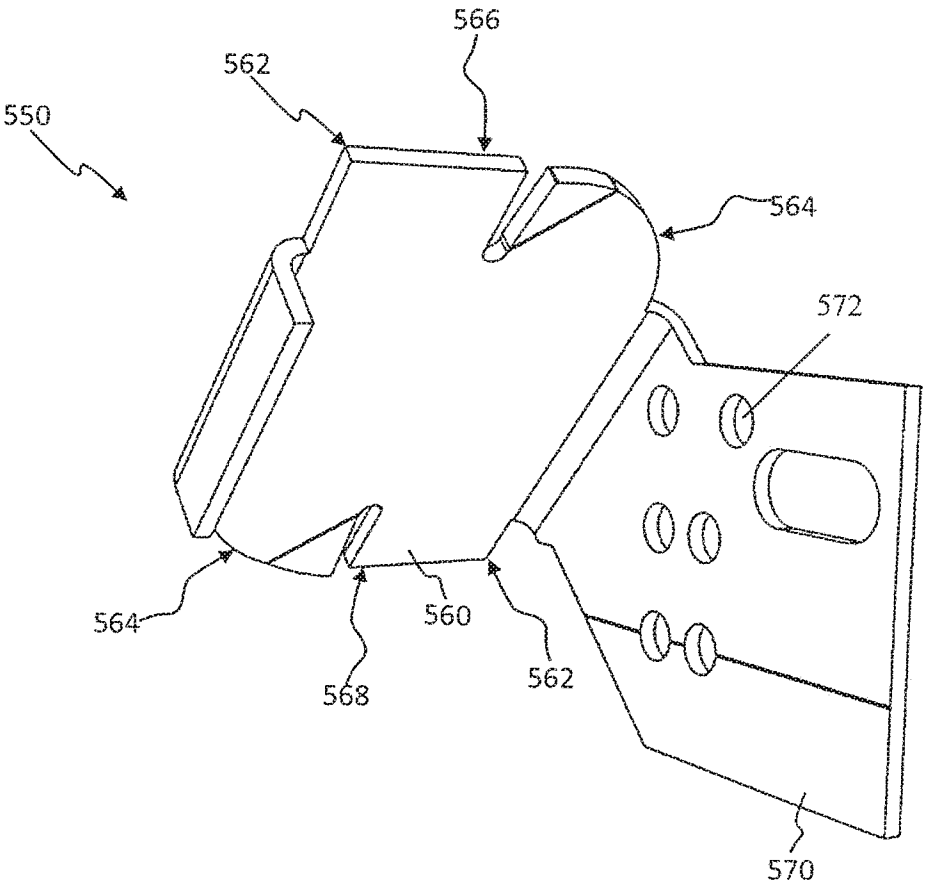
FIG. 11C is a perspective view of an angled ceiling beam connector, according to an embodiment of the invention.

As shown in FIG. 11C, the angled ceiling beam connector 550 includes a channel portion 560 and a beam portion 570 joined at an angle to the channel portion 560. The channel portion 560 is generally rectangular in cross section, includes two square corners 562 on diagonally opposing corners and two rounded corners 564 on the remaining two diagonally opposing corners, and has a substantially flat top surface 566 and a substantially flat bottom surface 568. The beam portion 570 includes a plurality of screw holes 572.

The angled cove edge piece 350 is secured to structure by the wall suspension hanger 200, which extends below the upper lateral arm 370 and is attached to the upper lateral arm 370 by a fastening element inserted between the key protrusions 372. In embodiments where the upper lateral arm 370 includes the pin hole 376, the bottom vertical arm 230 may contact the pin hole 376 to align the wall suspension hanger 200 and the angled cove edge piece 350. In other embodiments where the upper lateral arm 370 does not include the pin hole 376 or other vertical stop, the bottom vertical arm 230 may or may not contact the end bar 310 to align the wall suspension hanger 200 and the angled cove edge piece 350. The angled ceiling beam connector 550 is attached to the angled cove edge piece 350 by first vertically aligning the two rounded corners 564 between the beam connection hooks 362 of the angled cove edge piece 350. The ceiling beam connector 550 is then rotated to vertically align the top surface 566 and the bottom surface 568 so that the top surface 566 and the bottom surface 568 engage with the beam connection hooks 362. The ceiling beam 600 attaches to the angled ceiling beam connector 550 by a plurality of fastening elements, such as screws, inserted through the screw holes 572 and through the web 620. Before attaching the ceiling beam 600 to the angled ceiling beam connector 500, the ceiling beam 600 is cut at an angle equal to the angle formed between the angled end bar 360 and the lower lateral arm 380. As a result, the ceiling beam 600 extends nearly to the angled end bar 360 and the flanges 630 rest on the lower lateral arm 380, resulting in additional support for the ceiling beam 600 and a consistent, appealing appearance when viewed from below.

Figure 12A:
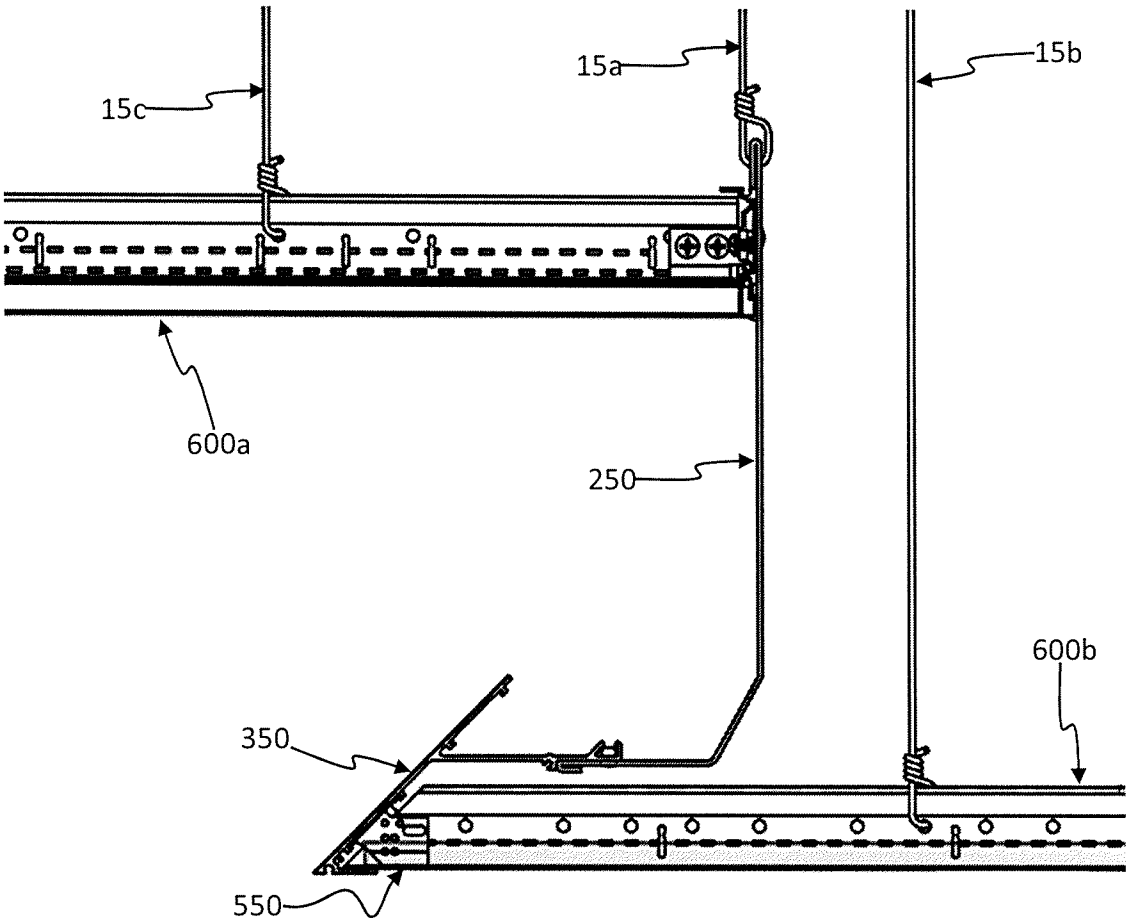
FIG. 12A is a side view of an indirect light cove system including two ceiling beams at different heights, according to an embodiment of the invention.

Referring to FIG. 12A, in further embodiments it may be desirable to position the indirect light cove away from a structural wall, for example in the center of a room. Accordingly, embodiments of the invention also include indirect light cove systems having an upper ceiling beam 600*a*, a beam-to-beam suspension hanger 250, the angled cove edge piece 350, the angled ceiling beam connector 550, and a lower ceiling beam 600*b*.

Figure 12B:
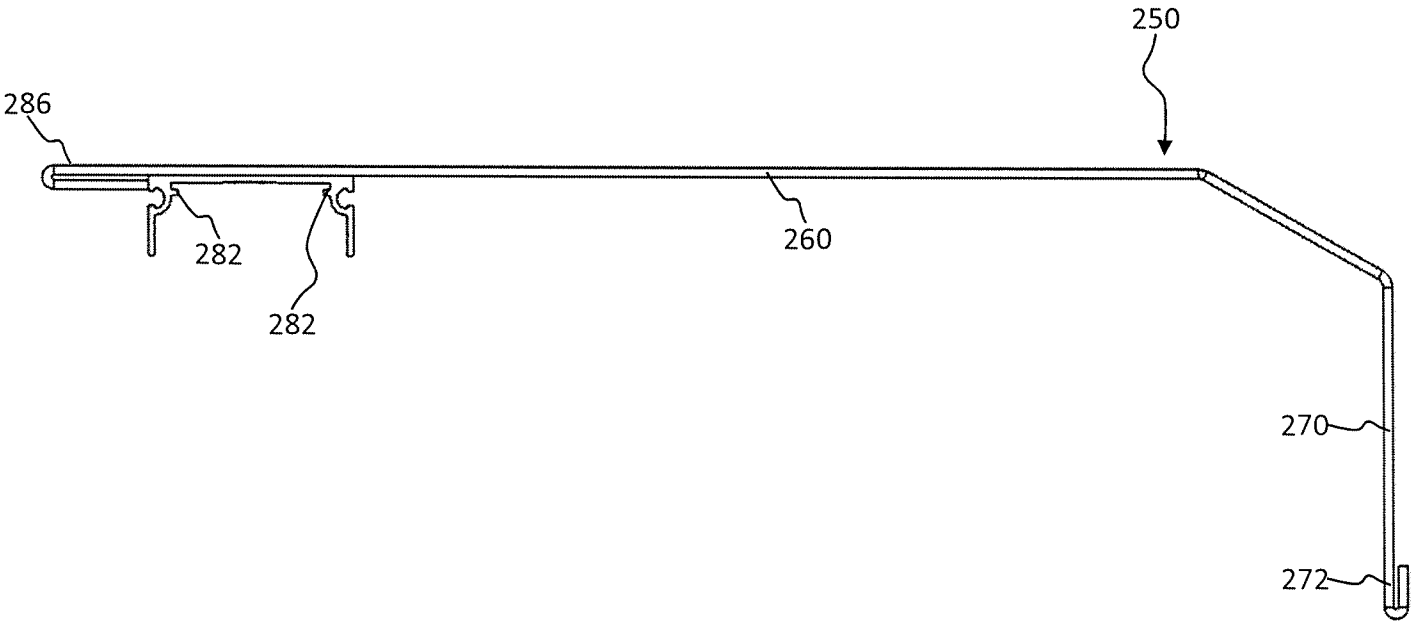
FIG. 12B is a side view of a beam-to-beam suspension hanger, according to an embodiment of the invention.

The beam-to-beam suspension hanger 250 (FIG. 12B) includes a vertical portion 260, and a bottom vertical arm 270 extending horizontally from the bottom of the vertical portion 260. The bottom vertical arm 270 includes a reinforcing bend 272 at the end opposite the vertical portion 260. At the opposite end from the bottom vertical arm 270, the vertical portion 260 includes a pair of beam connection hooks 282, and an extension 286 which extends past the beam connection hooks 282.

To install the indirect light cove system depicted in FIG. 12A, the upper ceiling beam 600*a* is first secured to structure (not shown) by any suitable mechanism, for example, a hanger wire 15*c*. The vertical ceiling beam connector 500 is then attached to the beam-to-beam suspension hanger 250 by slotting the upper rail 512 and lower rails 514 between the beam connection hooks 282 and sliding the vertical ceiling beam connector 500 laterally to the desired position. Once in position, the set screw 530 is tightened as described above to secure the vertical ceiling beam connector 500 to the beam-to-beam suspension hanger 250. The beam-to-beam suspension hanger 250 may also be secured by attaching the hanger wire 15*c* to the extension 286. The other end of the hanger wire 15*a* is secured to a structure (not shown) above the indirect light cove system. The angled cove edge piece 350, the angled ceiling beam connector 550, and the lower ceiling beam 600*b* may then be installed as described above.

Figure 13A:
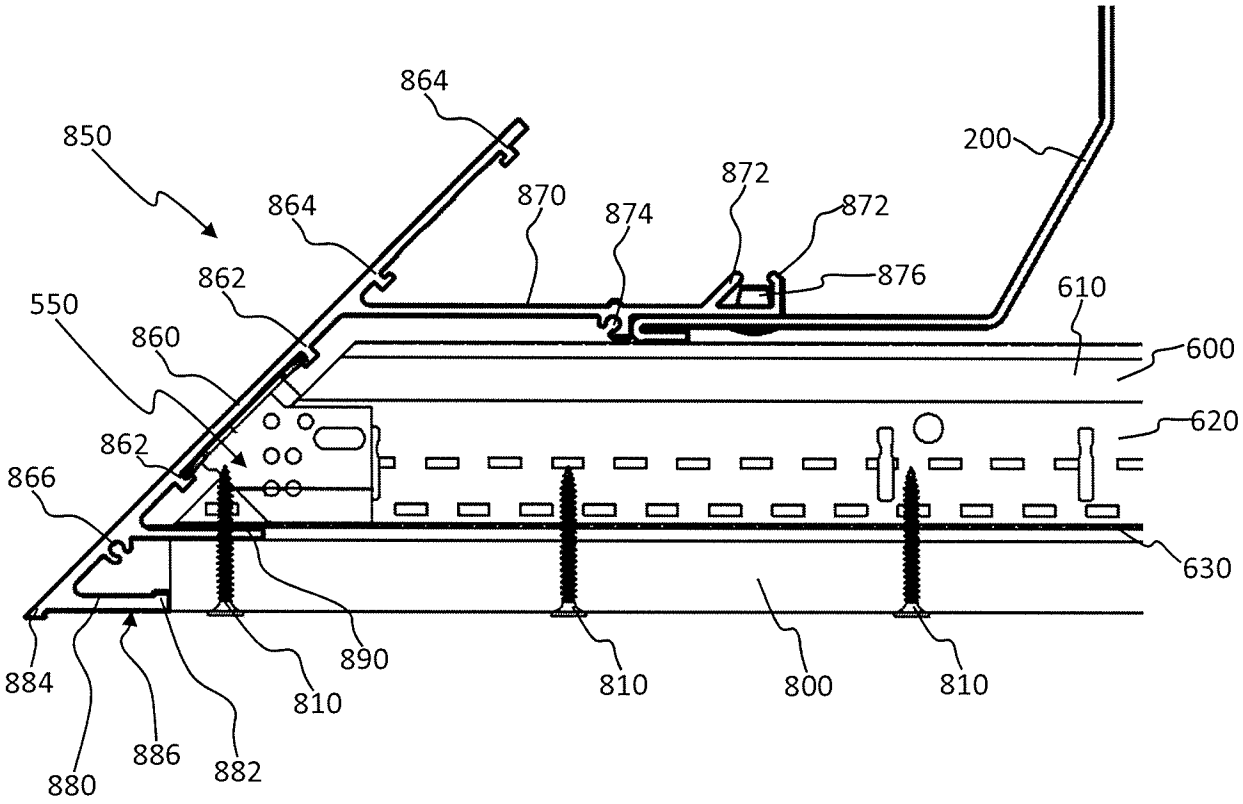
FIG. 13A is a side view of an indirect light cove system including an angled drywall cove edge piece, according to an embodiment of the invention.
Figure 13B:
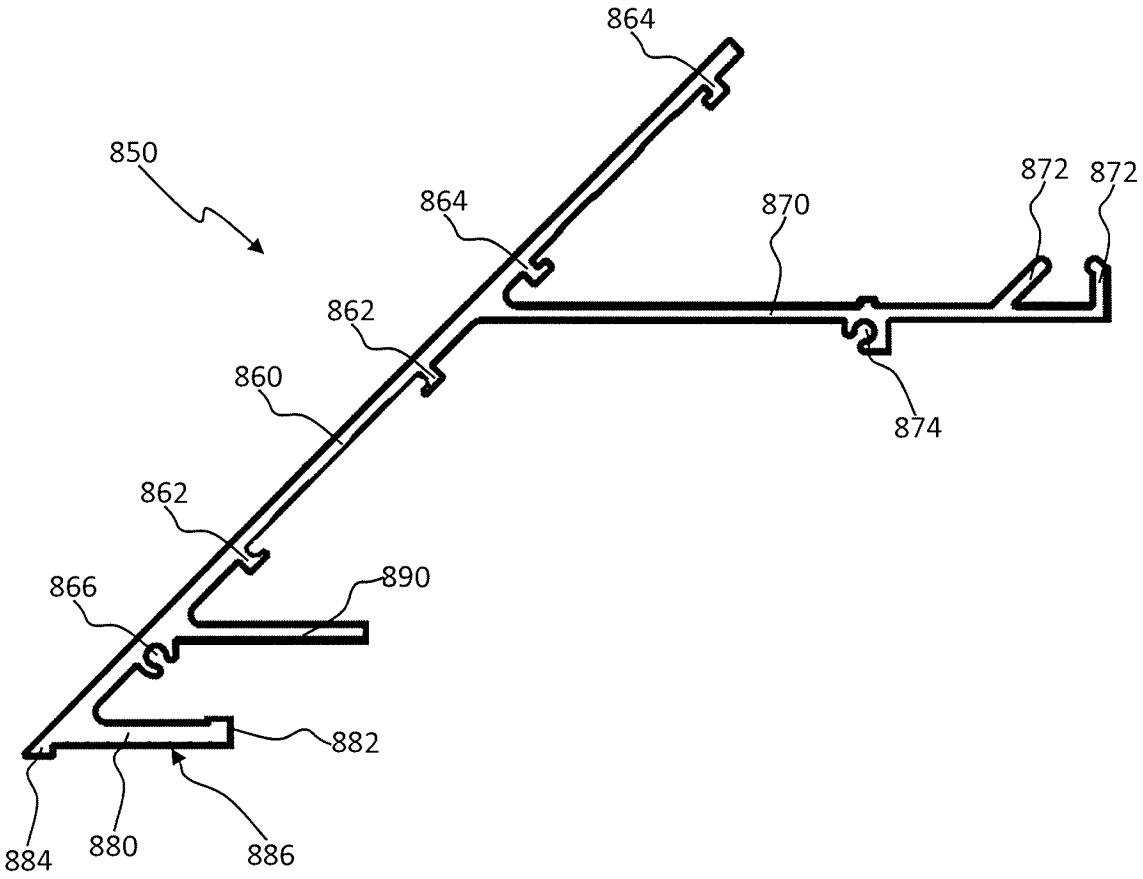
FIG. 13B is a side view of an angled drywall cove edge piece, according to an embodiment of the invention, according to an embodiment of the invention.

Referring to FIG. 13A, in still further embodiments it may be desirable for the indirect light cove to have an angled face and have a bottom drywall surface. Accordingly, embodiments of the invention also include indirect light cove systems having an angled drywall cove edge piece 850 rather than the angled cove edge piece 350 described above. The angled drywall cove edge piece 850 is adapted to facilitate the drywall hanging process and create a sharp, clean edge at the end of the angled drywall cove edge piece 850. The indirect light cove system depicted in FIG. 13A also includes the wall suspension hanger 200, the angled ceiling beam connector 550, and the ceiling beam 600. It will be understood that use of the beam-to-beam suspension hanger 250 would also be equally suitable in the indirect light cove system depicted in FIG. 13A.

The angled drywall cove edge piece 850 includes an angled end bar 860, an upper lateral arm 870, a bottom lateral arm 880, and a lower lateral arm 890. The upper lateral arm 870, the bottom lateral arm 880, and the lower lateral arm 890 are substantially parallel to each other. The angled end bar 860 joins the upper lateral arm 870, the bottom lateral arm 880, and the lower lateral arm 890 at angle of other than 90°. In an exemplary embodiment, each lateral arm forms an acute angle with the angled end bar 860 above the lateral arm and an obtuse angle with the angled end bar 860 below the lateral arm. The acute angle formed by the angled end bar 860 and each lateral arm may be any angle less than 90°, preferably approximately 30°-60°, and more preferably approximately 45°. The angled drywall cove edge piece 850 may be formed of a single piece of extruded metal. Alternatively, the angled drywall cove edge piece 850 may be made of multiple pieces.

The upper lateral arm 870 extends from an upper portion of the angled end bar 860 short of the terminal end of the angled end bar 860. The upper lateral arm 870 includes key protrusions 872 on an upper face of the upper lateral arm 870, and a pin hole 874 on a lower face of the upper lateral arm 870. The key protrusions 872 match an indentation on corresponding compatible light fixtures which are installed above the angled drywall cove edge piece 850 to ensure that only compatible light fixtures are used. Incompatible light fixtures will not align with the key protrusions 872 and therefore not fit above the upper lateral arm 870. A pin may be inserted into the pin hole 874 of adjacent angled drywall edge pieces 850 to ensure alignment between the adjacent angled drywall edge pieces 850. The pin hole 874 may also serve as a vertical stop, similar to the vertical stop 324 described above. Alternatively, the pin hole 874 may be excluded and a vertical stop (not shown) may be included in its place.

The bottom lateral arm 880 extends from the lower terminal end of the angled end bar 860. The bottom lateral arm 880 includes an upward-pointing end protrusion 882 and a lower protrusion 884. The lower protrusion 884 extends from the bottom lateral arm 880 parallel to the angled end bar 860. The bottom lateral arm 880 also includes a textured bottom 886. The textured bottom 886 may include a plurality of small ridges.

The lower lateral arm 890 extends from the angled end bar 860 at a position between the upper lateral arm 870 and the bottom lateral arm 880. As described in more detail below, the distance between the upper lateral arm 870 and the lower lateral arm 890 will depend on the height of the ceiling beam 600 (FIG. 13A) to which the angled drywall cove edge piece 850 attaches. The distance between the bottom lateral arm 880 and the lower lateral arm 890 will depend on the thickness of the drywall panel 800 (FIG. 13A) attached to the ceiling beam 600.

The angled end bar 860 further includes a pair of beam connection hooks 862 between the upper lateral arm 870 and the lower lateral arm 890, a pair of splice plate connection hooks 864 above the upper lateral arm 870, and a pin hole 866 between the bottom lateral arm 880 and the lower lateral arm 890. As described in more detail below, the beam connection hooks 862 are used to attach the angled drywall cove edge piece 850 to an adjacent ceiling beam 600 (FIG. 13A). Like the pin hole 874, a pin may be inserted into the pin hole 866 of adjacent angled drywall cove edge pieces 850 to ensure alignment between the adjacent angled drywall cove edge pieces 850. A splice plate (not shown) may also be inserted between the splice plate connection hooks 864 of adjacent angled drywall cove edge pieces 850 to further secure the adjacent angled drywall cove edge pieces 850.

The angled drywall cove edge piece 850 is secured to structure by the wall suspension hanger 200, which extends below the upper lateral arm 870 and is attached to the upper lateral arm 870 by a fastening element 876 inserted between the key protrusions 872. In embodiments where the upper lateral arm 870 includes the pin hole 874, the bottom vertical arm 230 may contact the pin hole 874 to align the wall suspension hanger 200 and the angled drywall cove edge piece 850. In other embodiments where the upper lateral arm 870 does not include the pin hole 874 or other vertical stop, the bottom vertical arm 230 may or may not contact the angled end bar 860 to align the wall suspension hanger 200 and the angled drywall cove edge piece 850. The angled ceiling beam connector 550 is attached to the angled drywall cove edge piece 850 by first vertically aligning the two rounded corners 564 between the beam connection hooks 362 of the angled cove edge piece 350. The angled ceiling beam connector 550 is then rotated to vertically align the top surface 566 and the bottom surface 568 so that the top surface 566 and the bottom surface 568 engage with the beam connection hooks 862. The ceiling beam 600 attaches to the angled ceiling beam connector 550 by a plurality of fastening elements (not shown), such as screws, inserted through the screw holes 572 and through the web 620.

Once the ceiling beam 600 is secured to the angled drywall cove edge piece 850, the drywall panel 800 may be secured to the ceiling beam 600. The drywall panel 800 is secured to the bottom of the flanges 630 of the ceiling beam 600 by drywall screws 810 which are screwed through the drywall panel 800 and the flanges 630. The drywall panel 800 is aligned by the bottom lateral arm 880, which offsets the end of the drywall panel 800 from the angled end bar 860. The end protrusion 882 provides a vertical stop to facilitate alignment of the drywall panel 800 with the bottom lateral arm 880. By offsetting the drywall panel 800, a drywall screw 810 may be affixed near the end of the drywall panel 800 without a risk of the drywall screw 810 piercing the angled end bar 860. The distance between the bottom lateral arm 880 and the lower lateral arm 890 is such that the bottom of the drywall panel 800 is substantially coplanar with the bottom of the bottom lateral arm 880.

Once the drywall panel 800 is secured to the ceiling beam 600, joint compound (not shown) may be applied to the bottom of the drywall panel 800 to seal any joints or holes in the drywall panel (e.g., holes formed by the drywall screws 810, or a joint between two adjacent drywall panels 800 which are both secured to the same ceiling beam 600) in order to prepare the drywall panel 800 for painting or other finishing. The angled drywall cove edge piece 850 is adapted to facilitate the application of drywall joint compound. Specifically, the textured bottom 886 of the bottom lateral arm 880 creates better adherence of the joint compound to the trim edge piece. The lower protrusion 884 also creates a small lip which is flush with the joint compound after it is applied to the bottom lateral arm 880 and drywall panel 800. This integrated stop makes it easier for a contractor to create a sharp, clean edge at the end of the trim edge piece and maintain a consistent knife-edge visual.

Certain preferred embodiments of indirect light coves for suspended ceiling systems have been described herein. Described above are various embodiments of indirect light cove systems including various combinations of elements. Each depicted embodiment includes a suspension hanger (i.e., either wall suspension hanger 200 or beam-to-beam suspension hanger 250), a cove edge piece (i.e., vertical cove edge piece 300, angled cove edge piece 350, or angled drywall cove edge piece 850), and a ceiling beam connector (i.e., vertical ceiling beam connector 500 or angled ceiling beam connector 550) which connects the cove edge piece to a ceiling beam. For example, the embodiment depicted in FIG. 1 includes a wall suspension hanger 200, a vertical cove edge piece 300, and a vertical ceiling beam connector 500. The embodiment depicted in FIG. 11A includes a wall suspension hanger 200, an angled cove edge piece 350, and an angled ceiling beam connector 550. The embodiment depicted in FIG. 12A includes a beam-to-beam suspension hanger 250, an angled cove edge piece 350, and an angled ceiling beam connector 550. The embodiment depicted in FIG. 13A includes a wall suspension hanger 200, an angled drywall cove edge piece 850, and an angled ceiling beam connector 550.

It will be apparent to one of ordinary skill in the art that these components may also be combined in various other iterations not expressly described herein. For example, an indirect light cove system according to the invention may include a beam-to-beam suspension hanger 250, vertical cove edge piece 300, and a vertical ceiling beam connector 500; a beam-to-beam suspension hanger 250, angled drywall cove edge piece 850, and an angled ceiling beam connector 550; or any other suitable combination. It is also to be understood that various modifications may be made to these described embodiments without departing from the spirit and scope of the invention. All such modifications and other embodiments are intended to be within the scope of the above description and in the following claims.

What is claimed:

1. An indirect light cove system comprising:

an edge piece including an end bar, an upper lateral arm joined to the end bar, a lower lateral arm having an upper face and a lower face and joined to the end bar below the upper lateral arm, the lower lateral arm being parallel to the upper lateral arm wherein the upper lateral arm extends further from the end bar than the lower lateral arm, one or more beam connection hooks on the end bar between the upper lateral arm and the lower lateral arm, and two or more key protrusions on an upper face of the upper lateral arm and a vertical stop on the lower face of the upper lateral arm;

a ceiling beam connector including a rectangular channel portion having a top surface and a bottom surface in contact with the beam connection hooks of the edge piece, and a beam portion joined to the channel portion including a plurality of screw holes;

a first ceiling beam including a bulb, a vertical web extending down from the bulb, and horizontally extending flanges at the bottom of the web, the first ceiling beam joined to the beam portion of the first ceiling beam connector by one or more fastening elements inserted through the screw holes of the beam portion and the web of the first ceiling beam, the flanges of the first ceiling beam resting on the lower lateral arm of the edge piece; and a lighting module including a key recess which substantially conforms to the key protrusions, the lighting module resting on the upper face of the upper lateral arm with the key protrusions inserted into the key recess.

2. The indirect light cove system of claim 1, wherein the edge piece is made of a single piece of extruded metal.

3. The indirect light cove system of claim 1, wherein the upper lateral arm joins to the end bar at an angle other than 90 degrees, and the upper lateral arm and the end bar form an acute angle above the upper lateral arm.

4. The indirect light cove system of claim 3, wherein the upper lateral arm joins to the end bar at an angle of approximately 30-60 degrees.

5. The indirect light cove system of claim 3, wherein the first ceiling beam includes an edge adjacent to the edge piece, the edge of the first ceiling beam forming substantially the same angle with the flanges as the upper lateral arm forms with the end bar.

6. The indirect light cove system of claim 3, wherein:

the edge piece further comprises a bottom lateral arm joined to the end bar below the lower lateral arm, the bottom lateral arm including an upward-pointing end protrusion at an end of the bottom lateral arm opposite the end bar, and a lower protrusion extending from the bottom lateral arm parallel to the end bar, and the indirect light cove system further comprises a drywall panel attached to the flanges of the first ceiling beam by a plurality of drywall screws, an edge of the drywall panel contacting with the upward-pointing end protrusion of the bottom lateral arm and a bottom surface of the drywall panel being substantially flush with a bottom surface of the bottom lateral arm.

7. The indirect light cove system of claim 6, further comprising a layer of drywall mud applied to the bottom of the drywall panel, the layer of drywall mud being substantially flush with a bottom surface of the lower protrusion of the bottom lateral arm.

8. The indirect light cove system of claim 1, further comprising a suspension hanger attached to a bottom surface of the upper lateral arm of the edge piece, the suspension hanger secured to the upper lateral arm by a fastening element inserted through the suspension hanger and the upper lateral arm between two of the plurality of key protrusions.

9. The indirect light cove system of claim 8, wherein the suspension hanger is further connected to a wall clip secured to a structural wall.

10. The indirect light cove system of claim 8, wherein the suspension hanger is further connected to a second ceiling beam higher than the first ceiling beam.

11. The indirect light cove system of claim 1, wherein one or more of the screw holes in the beam portion of the ceiling beam connector are slotted.

* * * * *